US007444923B2

(12) United States Patent
Horning et al.

(10) Patent No.: US 7,444,923 B2
(45) Date of Patent: Nov. 4, 2008

(54) SYNTHETIC LEATHER PACKINGS FOR RECIPROCATING PISTON PUMP

(75) Inventors: Jerry D. Horning, Albertville, MN (US); David J. Thompson, Oak Grove, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 1223 days.

(21) Appl. No.: 10/360,793

(22) Filed: Aug. 12, 2002

(65) Prior Publication Data

US 2006/0115369 A1 Jun. 1, 2006

(51) Int. Cl.
*F04B 53/00* (2006.01)
*B05B 9/04* (2006.01)

(52) U.S. Cl. ..... 92/240; 92/182

(58) Field of Classification Search ..... 92/182, 92/192, 240
See application file for complete search history.

(56) References Cited

U.S. PATENT DOCUMENTS

| | | | | |
|---|---|---|---|---|
| 4,639,471 | A * | 1/1987 | Hirai et al. | 521/172 |
| 5,290,905 | A * | 3/1994 | Komiya et al. | 528/80 |
| 5,435,697 | A * | 7/1995 | Guebeli et al. | 417/554 |
| 5,456,583 | A * | 10/1995 | Handzel | 417/554 |
| 5,891,538 | A * | 4/1999 | Yamamoto et al. | 525/179 |
| 6,558,141 | B2 * | 5/2003 | Vonalt et al. | 417/554 |
| 6,777,524 | B1 * | 8/2004 | Shimizu et al. | 560/158 |

* cited by examiner

*Primary Examiner*—Thomas E Lazo
(74) *Attorney, Agent, or Firm*—Douglas B. Farrow

(57) ABSTRACT

A packing stack for a reciprocating piston pump is formed of alternating V's of UHMWPE and either a polyurethane thermoplastic elastomer or an olefinic thermoplastic elastomer.

2 Claims, 2 Drawing Sheets

12
3
6
10
1

SYNTHETIC LEATHER PACKINGS FOR RECIPROCATING PISTON PUMP

BACKGROUND OF THE INVENTION

Various types of packings have been used over the years to seal reciprocating piston pumps such as those made by the assignee of the instant invention for pumping paint and similar materials. One popular construction for packing stacks is alternating V-cross-sectioned pieces of leather and another material such as UHMWPE (ultra high molecular weight polyethylene). The leather cushions and flexes allowing the UHMWPE to seal without undue wear. This material combination has also proven highly compatible with a variety of solvents and other components of the fluids to be pumped. One issue with the use of leather though is that as a natural substance, it is hard to maintain a consistent quality which would lead to consistent life. While stacks of alternating UHMWPE and PTFE are known to be used, the PTFE packings do not provide the same cushioning effect as the leather and thus will not perform in the same manner.

SUMMARY OF THE INVENTION

It is therefore an object of this invention to provide a packing construction which will yield a more consistent and predictable life and which is easily and inexpensively manufactured.

Towards that end, a packing stack is formed of alternating V's of UHMWPE and either a polyurethane thermoplastic elastomer or an olefinic thermoplastic elastomer. Such materials may be obtained from RTP Company of Winona, Minn. under the designations RTP 1299 X 97758 and RTP 2899 X 97862 respectively.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
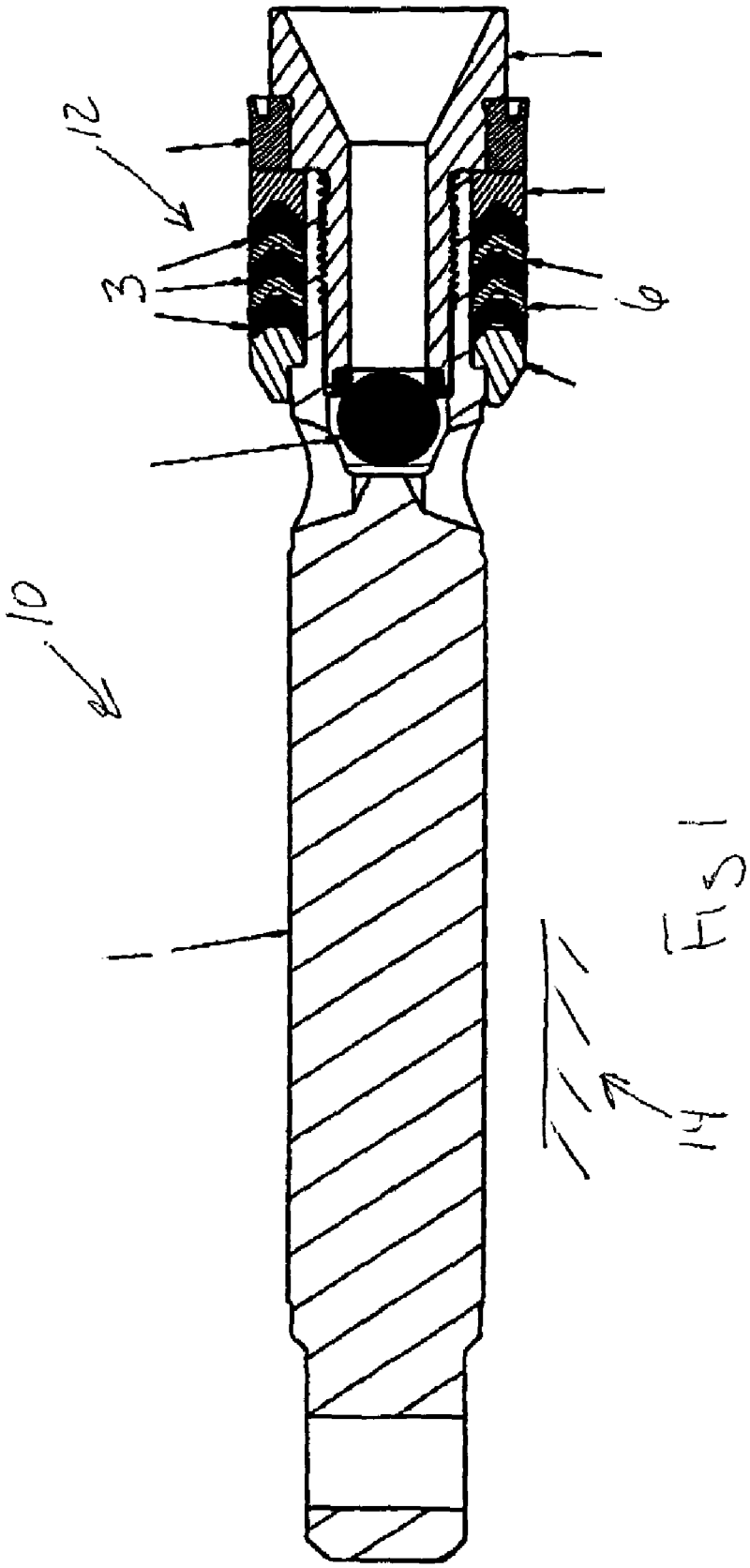
FIG. 1 is a cross section of a cylinder rod bearing the packings of the instant invention.
Figure 2:
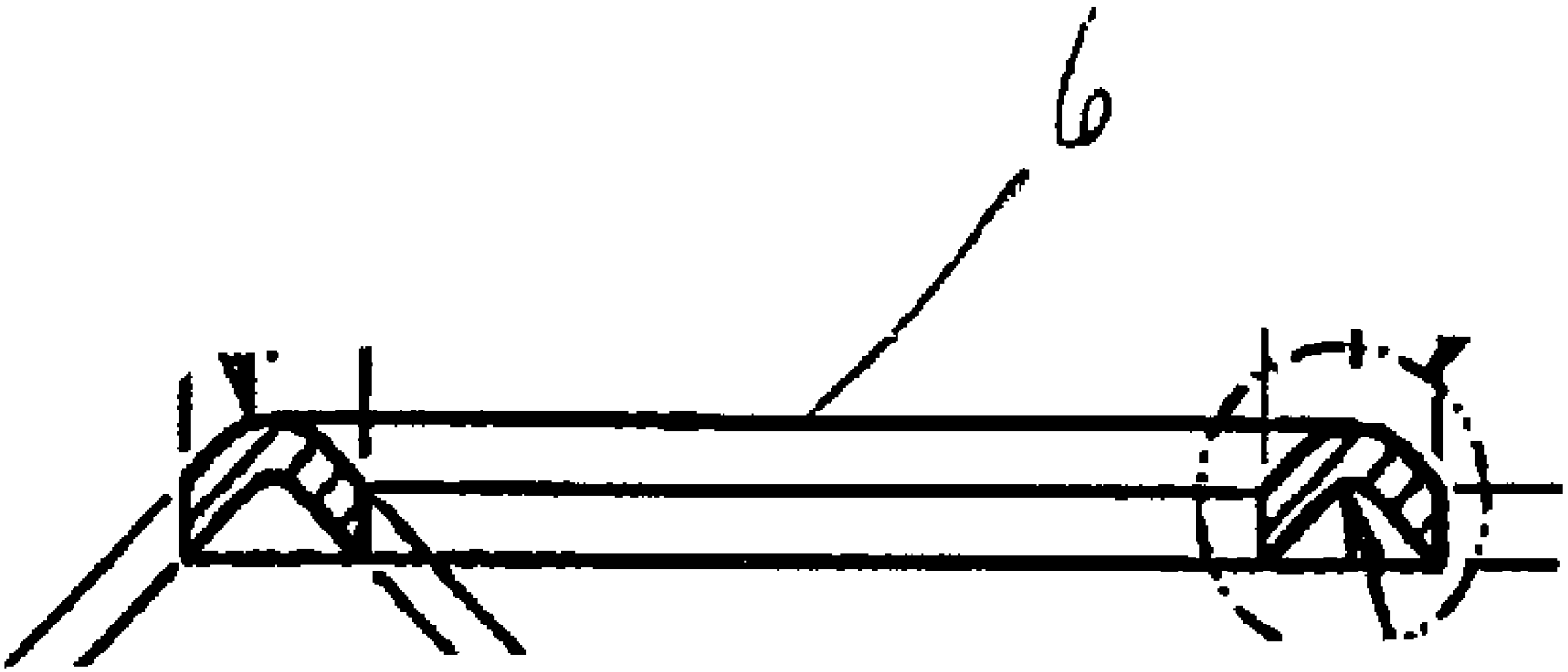
FIG. 2 is a cross section of the synthetic packing of the instant invention.

The instant invention, generally designated 10, is shown in FIGS. 1 and 2 and is designed for use in a reciprocating piston pump 14. A packing stack 12 is located on the exterior of piston rod 1 and is comprised of alternating UHMWPE vee packings 3 and synthetic leather packings 6. The outer edges of the packings 3 and 6 seal against the ID of a cylinder (not shown but conventional in nature). Synthetic leather packings 6 made be made of either a polyurethane thermoplastic elastomer or an olefinic thermoplastic elastomer. Such materials may be obtained from RTP Company of Winona, Minn. under the designations RTP 1299 X 97758 and RTP 2899 X 97862 respectively.

It is contemplated that various changes and modifications may be made to the packings without departing from the spirit and scope of the invention as defined by the following claims.

What is claimed is:

1. A reciprocating piston pump for pumping paints and other viscous abrasive materials and having a cylinder, a piston rod in said cylinder and a packing stack located between said cylinder and said piston, the improvement comprising said packing stack being formed of alternating vee packings of a sealing material and a synthetic leather, said synthetic leather comprising an olefinic thermoplastic elastomer.

2. A packing stack for use in a reciprocating piston pump for pumping paints and other viscous abrasive materials and being formed of alternating vee packings of a sealing material and a synthetic leather, said synthetic leather comprising an olefinic thermoplastic elastomer.

* * * * *